US008104650B2

(12) United States Patent
Lang et al.

(10) Patent No.: US 8,104,650 B2
(45) Date of Patent: Jan. 31, 2012

(54) ANTI DRIP DEVICE FOR LIQUID DISPENSERS

(75) Inventors: Christopher James Lang, Nottinghamshire (GB); Shaun Kerry Matthews, Lincoln (GB)

(73) Assignee: Pibed Ltd., Belper (GB)

( * ) Notice: Subject to any disclaimer, the term of this patent is extended or adjusted under 35 U.S.C. 154(b) by 601 days.

(21) Appl. No.: 12/155,667

(22) Filed: Jun. 6, 2008

(65) Prior Publication Data

US 2009/0302072 A1 Dec. 10, 2009

(51) Int. Cl.
*B65D 5/72* (2006.01)

(52) U.S. Cl. ..... 222/571; 222/190

(58) Field of Classification Search ..... 222/571, 222/108, 190, 145.6, 321.7, 321.9, 321.1, 222/148; 215/41, 391; 220/719, DIG. 5; 239/428.5

See application file for complete search history.

(56) References Cited

U.S. PATENT DOCUMENTS

| | | | | |
|---|---|---|---|---|
| 3,642,213 | A * | 2/1972 | Parkison et al. | 239/590 |
| 5,803,368 | A * | 9/1998 | Shekalim | 239/428.5 |
| 6,126,093 | A * | 10/2000 | Grether et al. | 239/428.5 |
| 6,446,840 | B2 * | 9/2002 | Ophardt et al. | 222/190 |
| 6,601,736 | B2 * | 8/2003 | Ophardt et al. | 222/181.1 |
| 6,708,902 | B2 * | 3/2004 | Takeshi et al. | 239/428.5 |
| 7,004,356 | B1 | 2/2006 | Sayers | |
| 7,357,337 | B2 * | 4/2008 | Ferrari | 239/428.5 |
| 7,641,077 | B2 * | 1/2010 | Law et al. | 222/190 |
| 7,661,608 | B2 * | 2/2010 | Grether | 239/500 |
| 7,673,854 | B2 * | 3/2010 | Brouwer et al. | 261/28 |
| 7,708,166 | B2 * | 5/2010 | Ophardt | 222/190 |
| 2004/0199995 | A1 * | 10/2004 | Bui | 4/676 |

FOREIGN PATENT DOCUMENTS

| | | |
|---|---|---|
| DE | 4423036 | 10/1995 |
| EP | 1494818 | 5/2006 |
| GB | 2325871 | 12/1998 |
| WO | 2004/069418 | 8/2004 |

OTHER PUBLICATIONS

Int'l Search Report PCT/EP2009/0055673.

* cited by examiner

*Primary Examiner* — Lien Ngo
(74) *Attorney, Agent, or Firm* — Dowell & Dowell, P.C.

(57) ABSTRACT

An anti-drip device is for use in association with a liquid dispenser having a nozzle. The anti-drip device is adapted to fit into the nozzle. The device has an outer cross sectional dimension, an inner cross sectional dimension and an inner surface. The inner cross sectional dimension is the sum of a length of the inner surface and the inner surface is shaped such that the inner cross sectional dimension is larger than a length of the outer cross sectional dimension.

17 Claims, 10 Drawing Sheets

ANTI DRIP DEVICE FOR LIQUID DISPENSERS

FIELD OF THE INVENTION

This invention relates to dispensers and in particular anti-drip devices for dispensers that reduce the drip after operation.

BACKGROUND OF THE INVENTION

Liquid dispensers are almost ubiquitous. Liquid dispensers are found in many public restrooms, hospitals, restaurants and other establishments. More recently there has been a trend towards liquid dispensers which dispense foam. These dispensers have the distinct advantage of reducing the amount of liquid dispensed in each shot when compared to non-foaming dispensers. Many of these dispensers drip somewhat after use. This is particularly true for inverted dispensers. Generally the amount of drip is dependent on the type of dispenser and the viscosity of the liquid. Accordingly, the drip problem is more of an issue with foam dispensers since the low viscosity soap that is used with foam dispensers is more prone to drip.

Accordingly it would be advantageous to provide a device that would decrease the drip after use.

SUMMARY OF THE INVENTION

The present invention relates to an anti-drip device for use in association with a liquid dispenser having a nozzle. The anti-drip device is adapted to fit into the nozzle. The device has an outer cross sectional dimension, an inner cross sectional dimension and an inner surface. The inner cross sectional dimension is the sum of a length of the inner surface and the inner surface is shaped such that the inner cross sectional dimension is larger than a length of the outer cross sectional dimension.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 1:
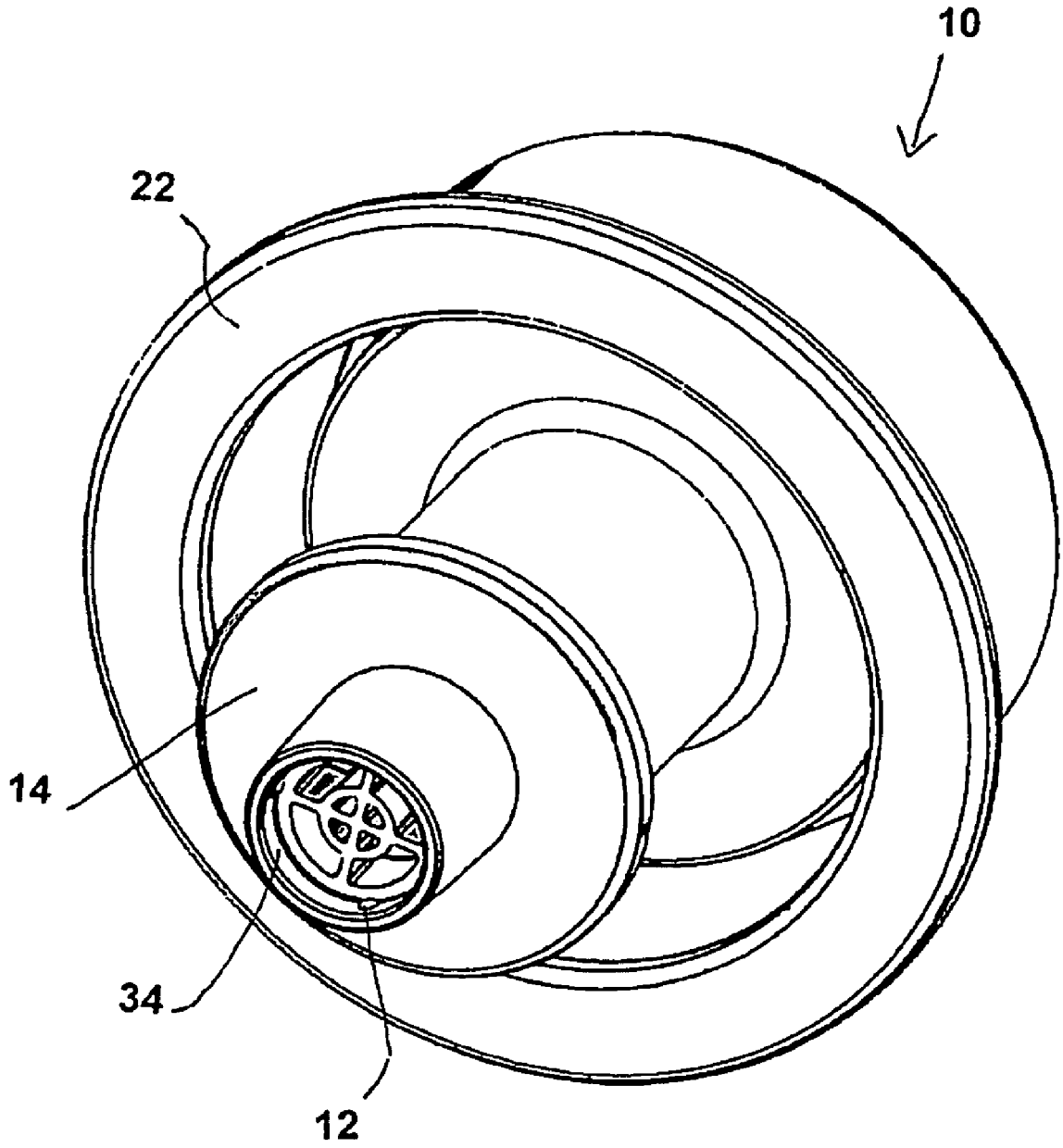
FIG. 1 is a perspective view of a nozzle with an anti-drip device of the present invention installed therein.
Figure 2:
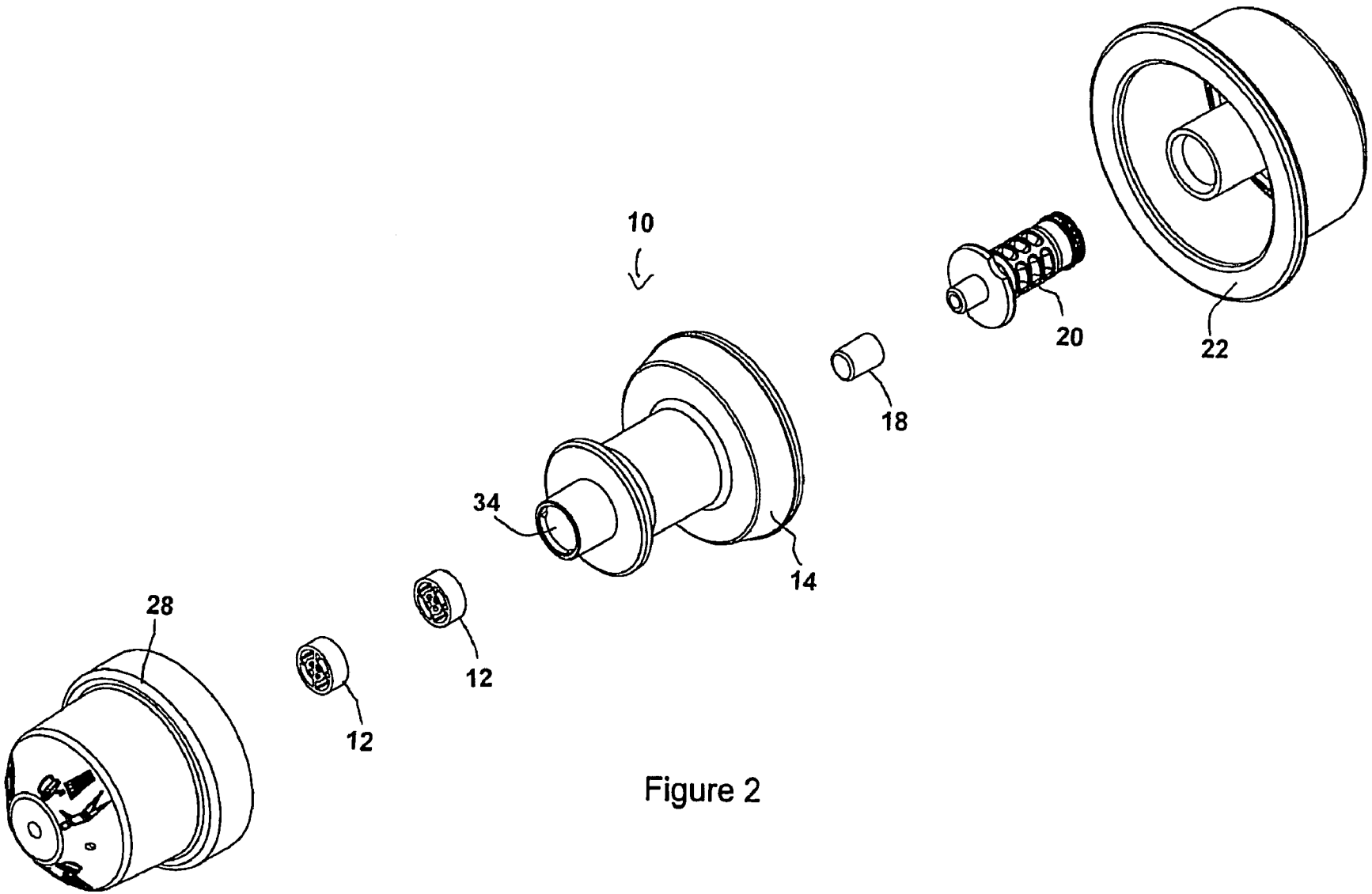
FIG. 2 is a blown apart perspective view of the nozzle of FIG. 1.

Referring to FIGS. 1 and 2, the nozzle is shown generally at 10. Nozzle 10 includes at least one anti-drip device 12 that may have a variety of different cross sectional configurations, some examples of which are shown hereafter. The common feature in all of the different configurations is that the anti-drip device includes inner walls that increase the surface area. In use, the anti-drip device provides a zone in the nozzle with an increased surface area. By increasing the surface area there is more surface for the liquid to cling to when the dispenser is not in use thereby reducing the likelihood of drips.

Nozzle 10 includes an anti-drip device 12 that is positioned foam cone 14. A foam piston 20 is positioned in the foam cone 14 with a top hat valve 18 at one end thereof. The foam cone 14 is connected to a bottle seal 22 which is in turn connected to a collapsible bottle 24 which is inside a dispenser 26 (shown in FIGS. 15 and 16). A cap 28 is provided to seal the nozzle 10 particularly during transit.

Figure 3:
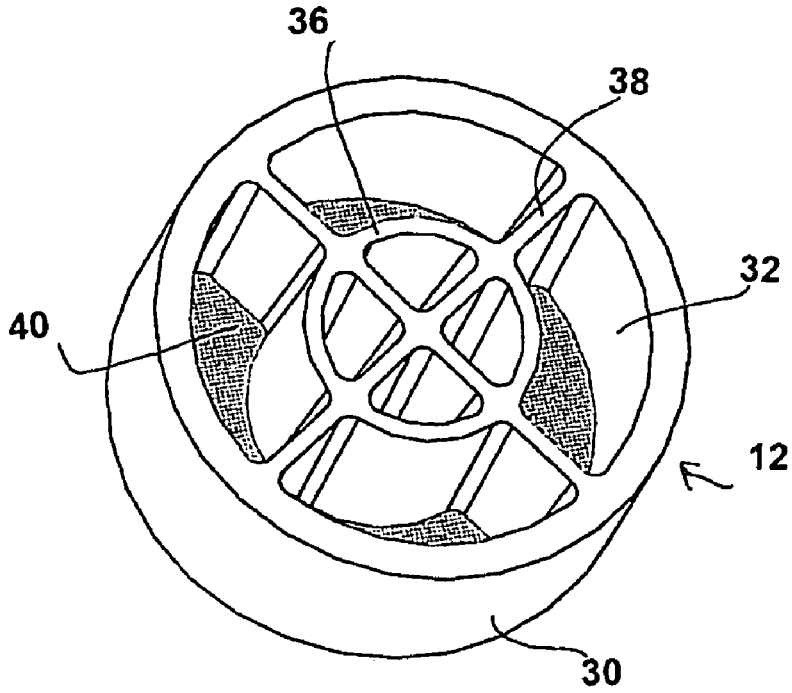
FIG. 3 is a perspective view of the anti-drip device as shown in FIGS. 1 and 2.
Figure 4:
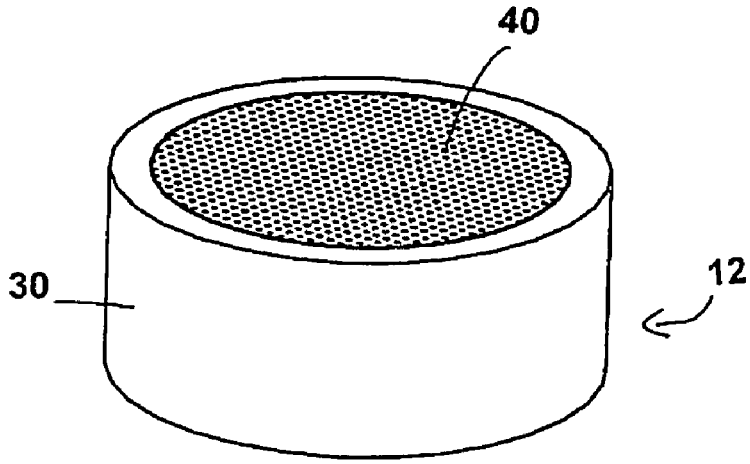
FIG. 4 is a perspective view of the anti-drip device of FIG. 3 with a porous member attached to one side thereof.

The anti-drip device 12 as best seen in FIGS. 1 and 3 has an external surface 30 and inner walls which define an internal surface 32 (shown in FIG. 3). The cross sectional dimension of the external surface 30 corresponds with the internal cross sectional dimension of the exit portion 34 of the nozzle 10. The internal surface 32 has an increased surface area when compared to the external surface 30.

In the anti-drip device shown in FIGS. 1 to 3 the inner surface includes an inner portion or ring 36 bisected by intersecting arms 38 forming a pattern referred to as a cruciform pattern. Anti-drip device 12 may have a porous member 40 attached thereto on one or both sides thereof.

Figure 6:
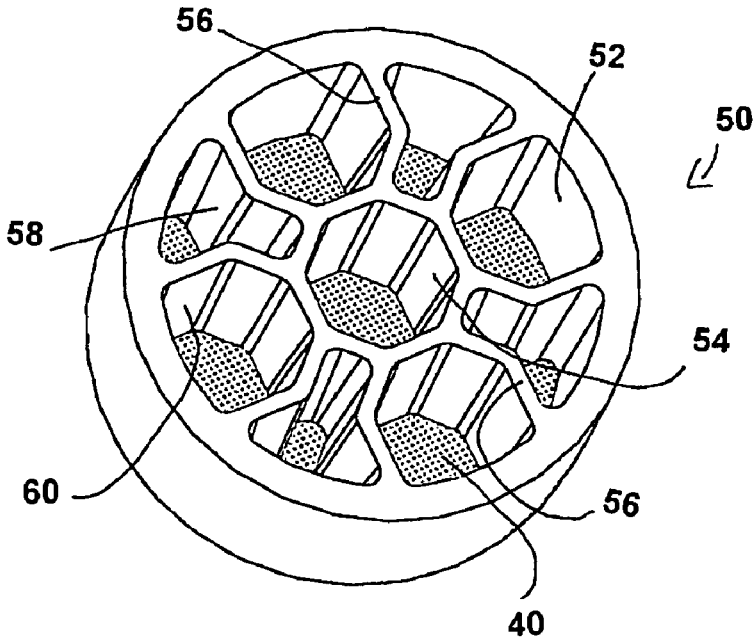
FIG. 6 is a perspective view of the anti-drip device as shown in FIG. 5.
Figure 7:
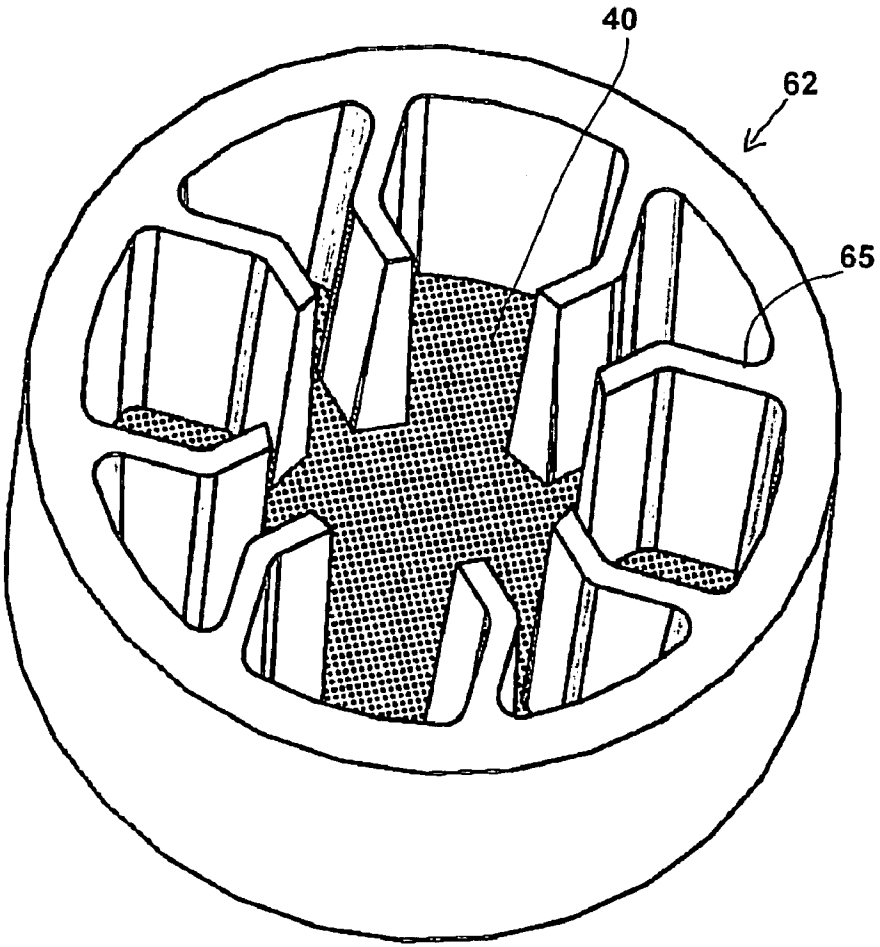
FIG. 7 is a perspective view of another alternate view of an anti-drip device of the present invention.

It will be appreciated by those skilled in the art that there are a wide variety of different configurations that may be used for the internal surface in order to increase the surface area in at least one portion of the exit nozzle. Some alternate examples are shown in FIGS. 6 and 7. However, clearly these configurations are just by way of example and many other configurations could also be used. As well, one or more anti-drip device may be used. In addition to the anti-drip device a plain insert with a porous member attached to one or both sides thereof may also be inserted into the nozzle. As well, the anti-drip device may have a porous member attached thereto on one or both sides thereof.

Figure 5:
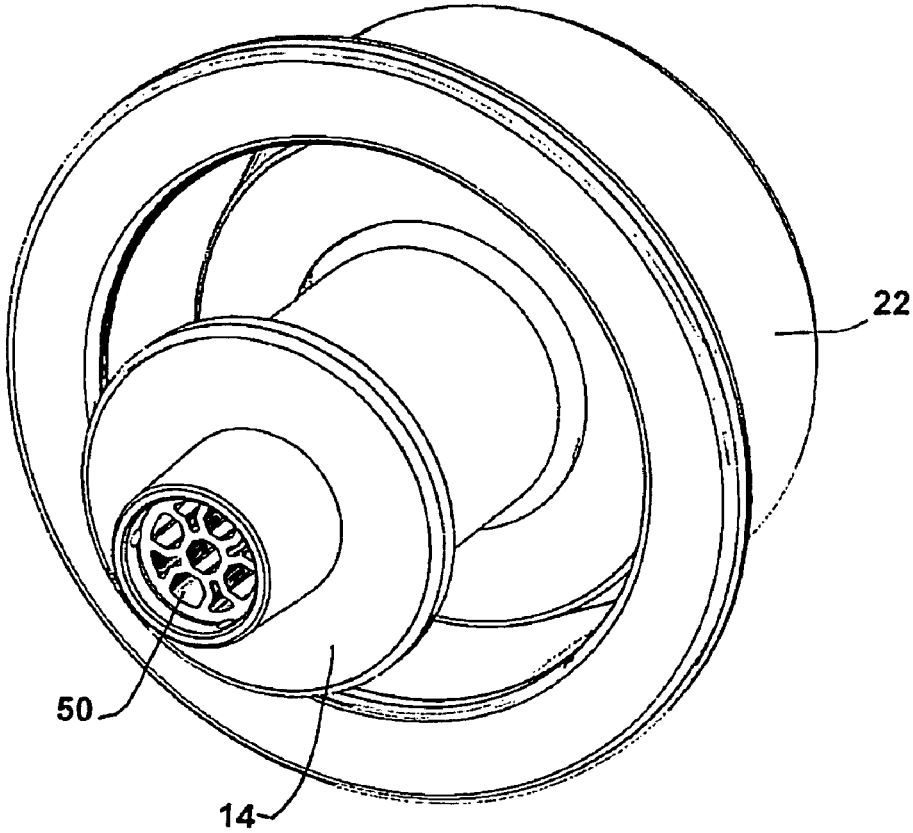
FIG. 5 is a perspective view of a nozzle similar to that shown in FIG. 1 but showing an alternate embodiment of the anti-drip device of the present invention installed therein.

FIGS. 5 and 6 show an alternate anti-drip device 50 wherein the inner surface 52 has different configuration. Inner surface 52 includes a central octagonally shaped ring or portion 54 with plurality of arms 56 extending between the central ring 54 and the outer portion of the anti-drip device. The arms 56 create shapes somewhat like a fat "T" 58 and a barn shape 60. However, it will be appreciated by those skilled in the art that any suitable shapes may be used. In general the surface area created by the fat "T" 58 and the barn shape 60 are similar.

Another alternative configuration for the anti-drip device is shown in FIG. 7 at 62. Anti-drip device 62 has a plurality of arms 65 extending inwardly from the outer portion. As discussed above arms 62 serve to increase the surface area of the anti-drip device. The configuration of anti-drip device 62 is similar to anti-drip device 50 shown in FIGS. 5 and 6 but not including the central ring 54.

Figure 8:
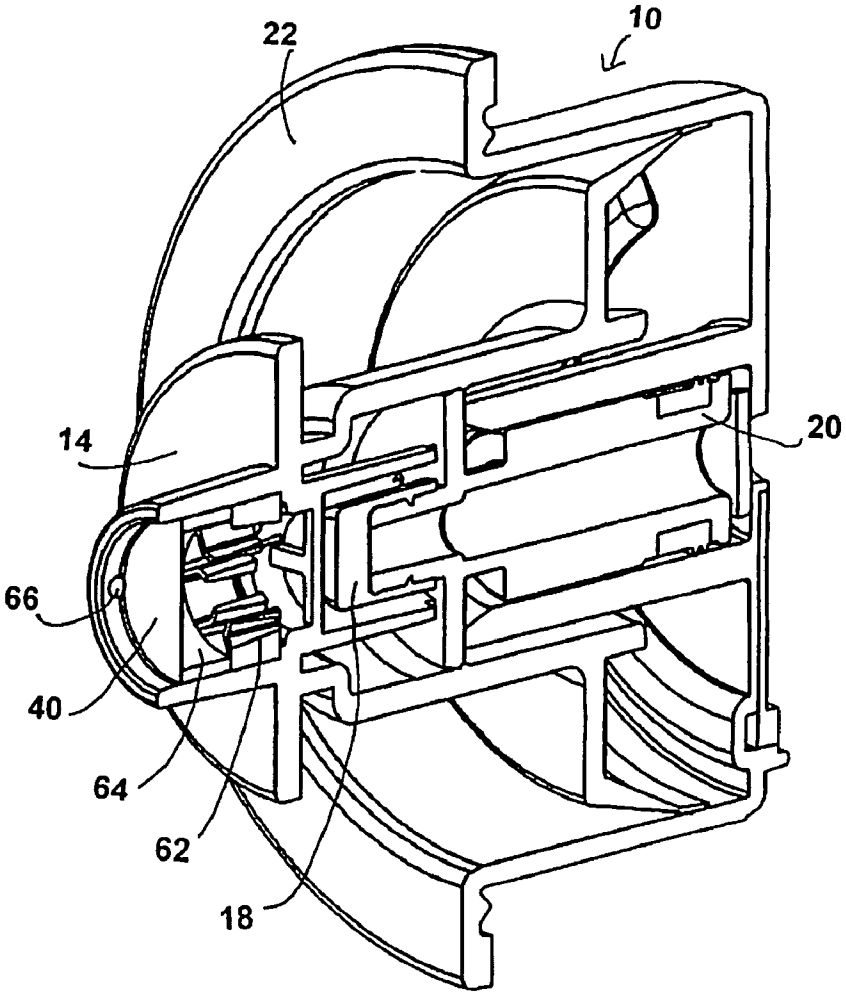
FIG. 8 is a broken away perspective view of the embodiment of the anti-drip device shown in FIG. 7 and a circular anti-drip device both positioned in a nozzle.
Figure 10:
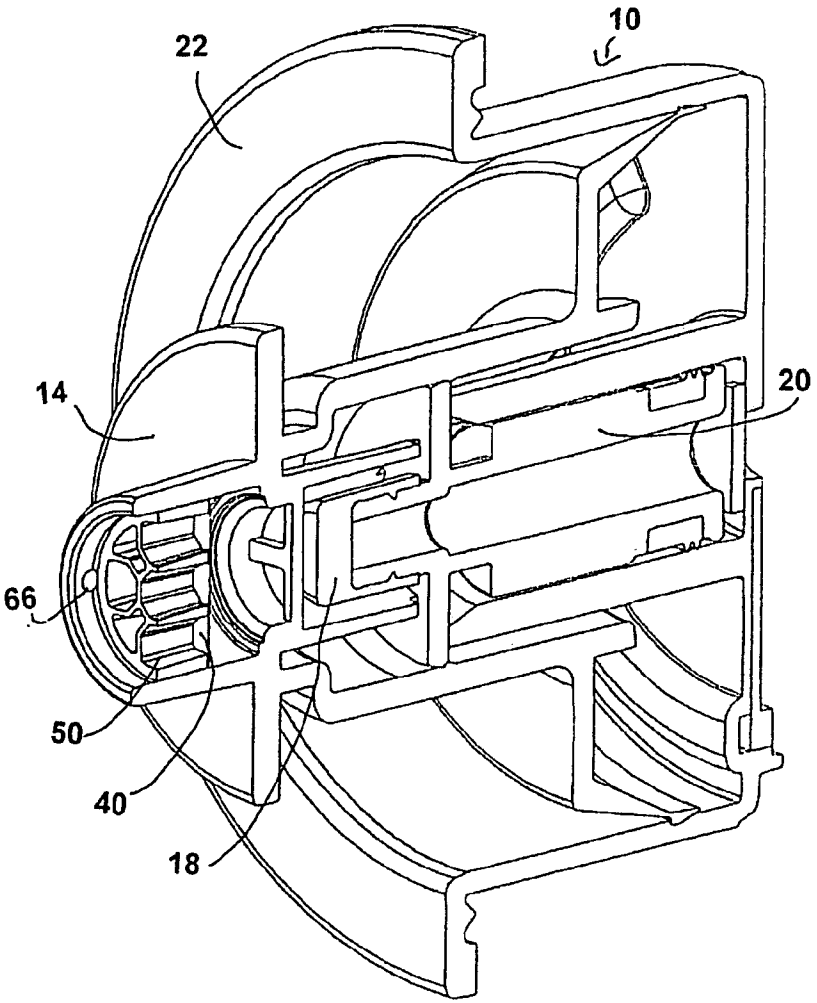
FIG. 10 is a broken away perspective view of the embodiment of the anti-drip device shown in FIG. 6 positioned in a nozzle.
Figure 9:
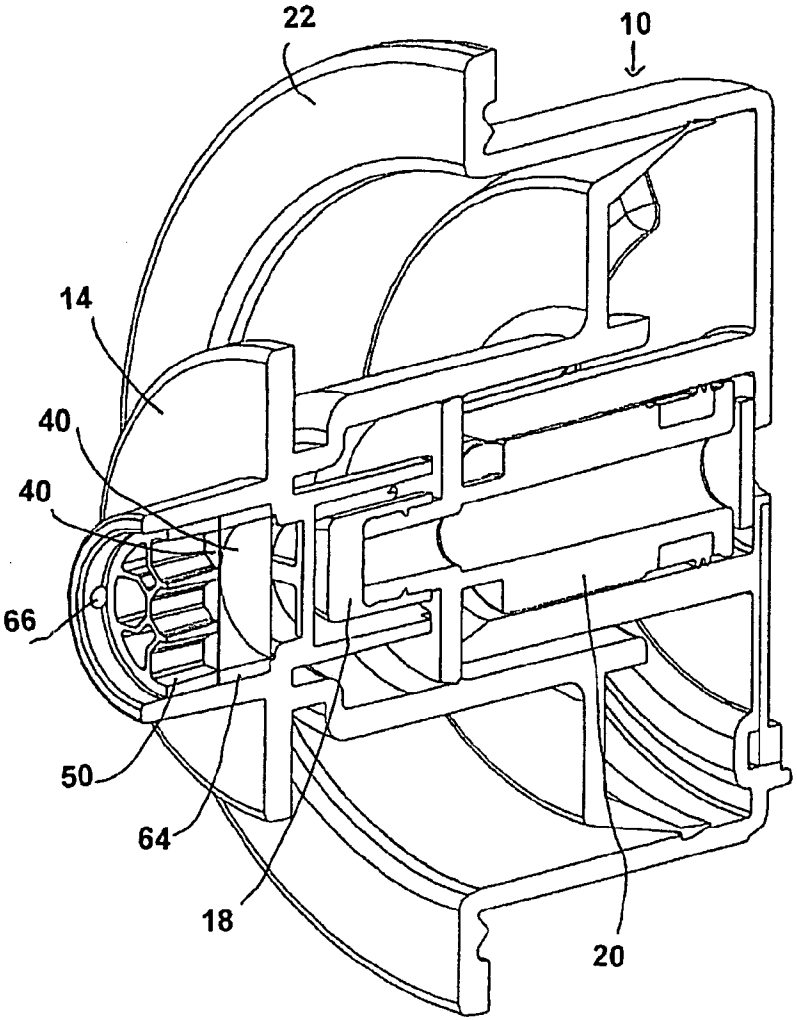
FIG. 9 is a broken away perspective view of the embodiment of the anti-drip device shown in FIG. 6 and a circular anti-drip device positioned in a nozzle but in a different configuration than that shown in FIG. 8.
Figure 12:
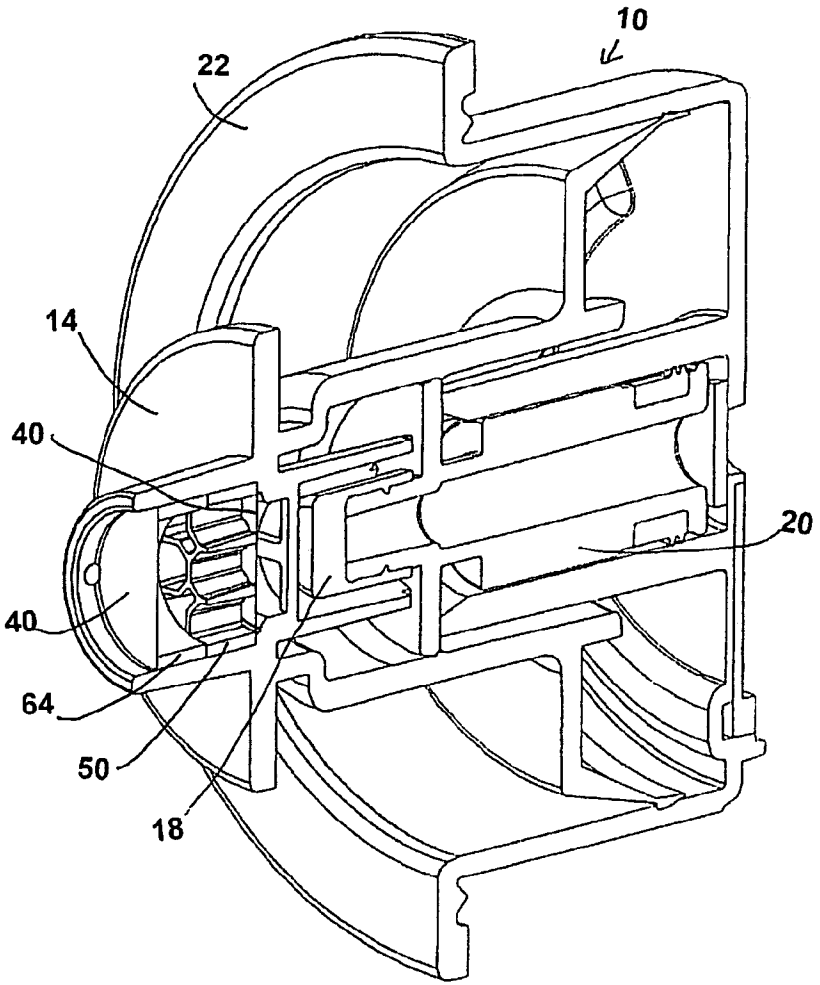
FIG. 12 is a broken away perspective view of the embodiment of the anti-drip device shown in FIG. 6 with a porous member attached thereto and a circular anti-drip device positioned in a nozzle in a configuration similar to that shown in FIG. 8
Figure 11:
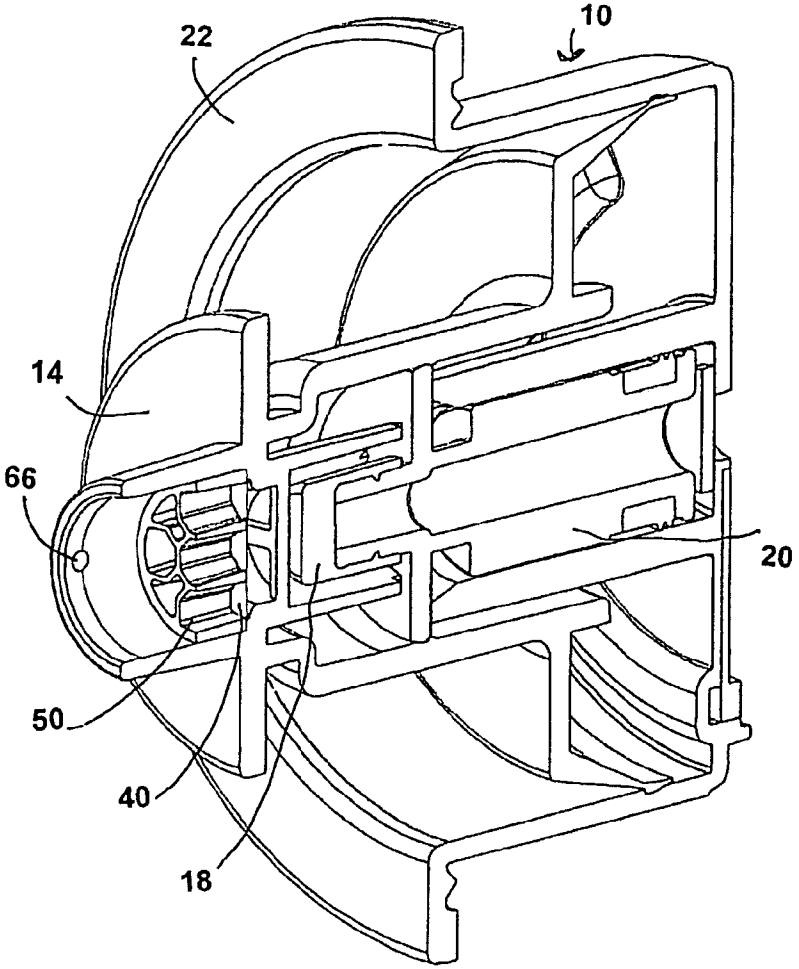
FIG. 11 is a broken away perspective view of the embodiment of the anti-drip device shown in FIG. 6 positioned in a nozzle but in a different configuration than that shown in FIG. 10.

FIGS. 8 through 12 show different combinations of the anti-drip devices and positions of the porous member 40 attached to the anti-drip device. FIG. 8 shows anti-drip device 62 positioned in the foam cone 14 upstream of a plain insert 64. Plain insert has an outer cross sectional shape that is generally the same as its inner cross sectional shape. Plain insert 64 has a porous member 40 attached to the downstream side of the anti-drip device. No porous member is attached to anti-drip device 62. Anti-drip devices 62 and insert 64 are press fit into foam cone 14. In addition a detent 66 extends inwardly from the inside of foam cone 14 to further hold anti-drip device 62 and plain insert 64 in place. FIG. 9 shows a configuration wherein plain insert 64 with a porous member attached to the upstream side thereof is upstream of anti-drip device 50 which also has a porous member attached to the upstream side thereof. FIG. 10 shows a configuration wherein anti-drip device 50 with a porous member on the upstream end thereof is at the downstream end of foam cone 14. FIG. 11 is similar to the configuration shown in FIG. 10 but anti-drip device 50 is at the upstream end of foam cone 14. FIG. 12 shows anti-drip device 50 with a porous member attached to the upstream end thereof upstream of plain insert 64 with a porous member attached to the down stream end thereof. Preferably the porous member 40 is gauze. It will be appreciated by those skilled in the art that in the configurations with more than one gauze attached to the anti-drip devices the gauze may have either the same gauge or a different gauge. Where a different gauge is used typically the upstream gauze will have a coarser gauge than the downstream gauze.

Figure 14:
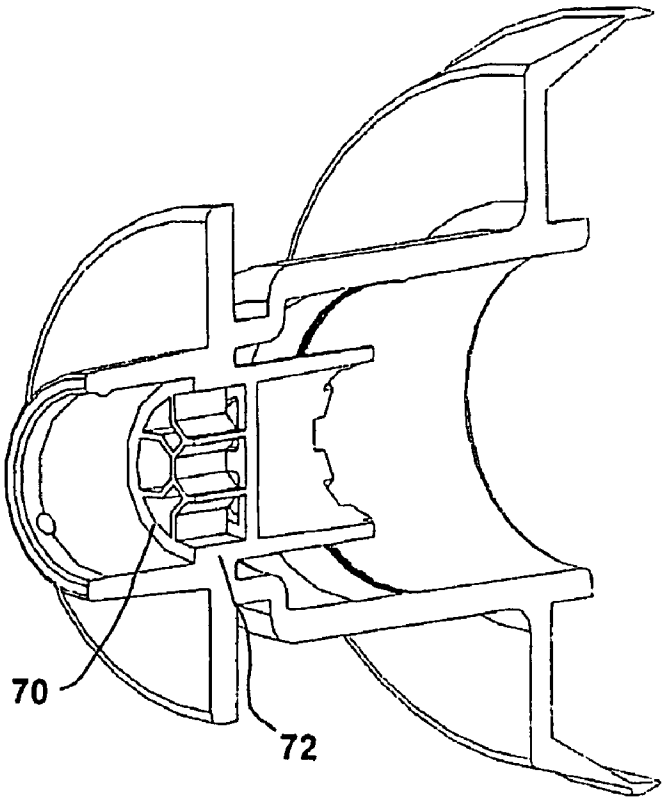
FIG. 14 is a broken away perspective view of the embodiment of the anti-drip device shown in FIG. 13.
Figure 13:
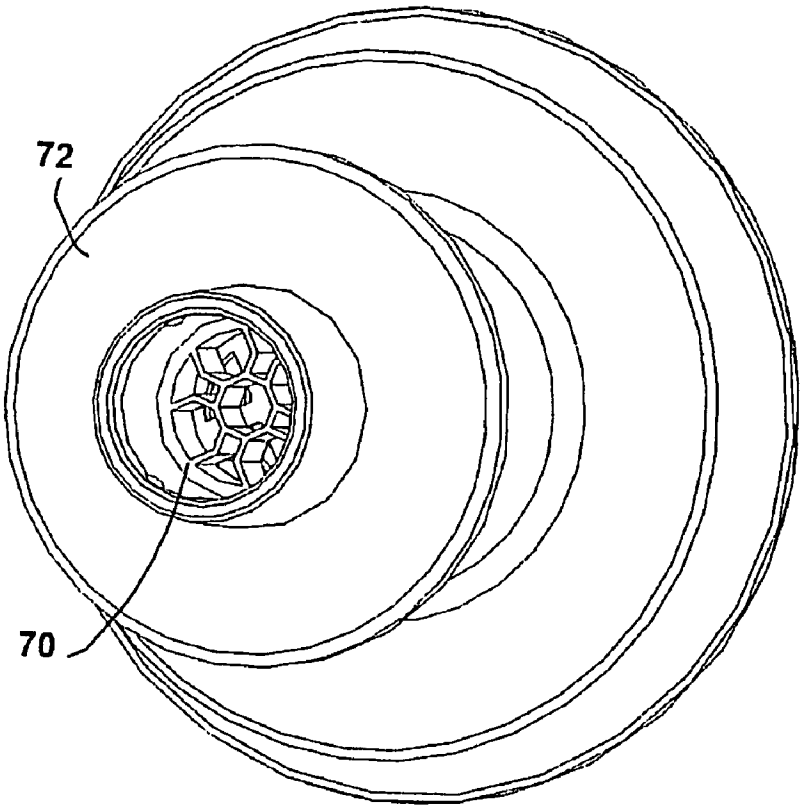
FIG. 13 is a perspective view of an alternate embodiment of anti-drip device that is integrally formed in the nozzle.

It will be appreciated that the same advantages may be achieved with a nozzle having an exit portion that is integrally formed as part of the nozzle. Such an example is shown in FIGS. 13 and 14 wherein anti-drip device 70 is integrally formed in foam cone 72. Anti-drip device 70 has a configuration similar to that of anti-drip device 50 shown in FIGS. 5 and 6 but it is integrally formed as a portion of foam cone 72.

Figure 16:
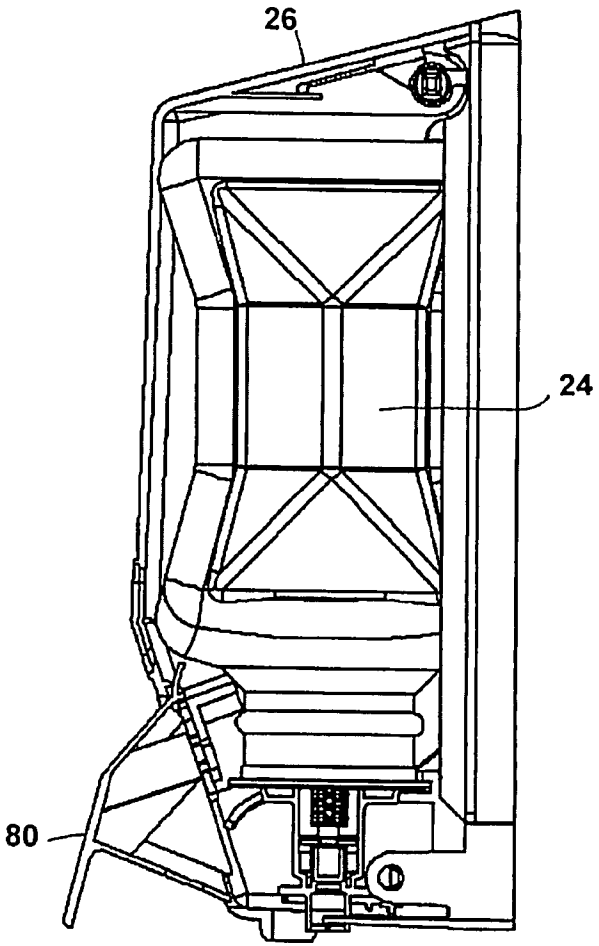
FIG. 16 is a side view of FIG. 15.
Figure 15:
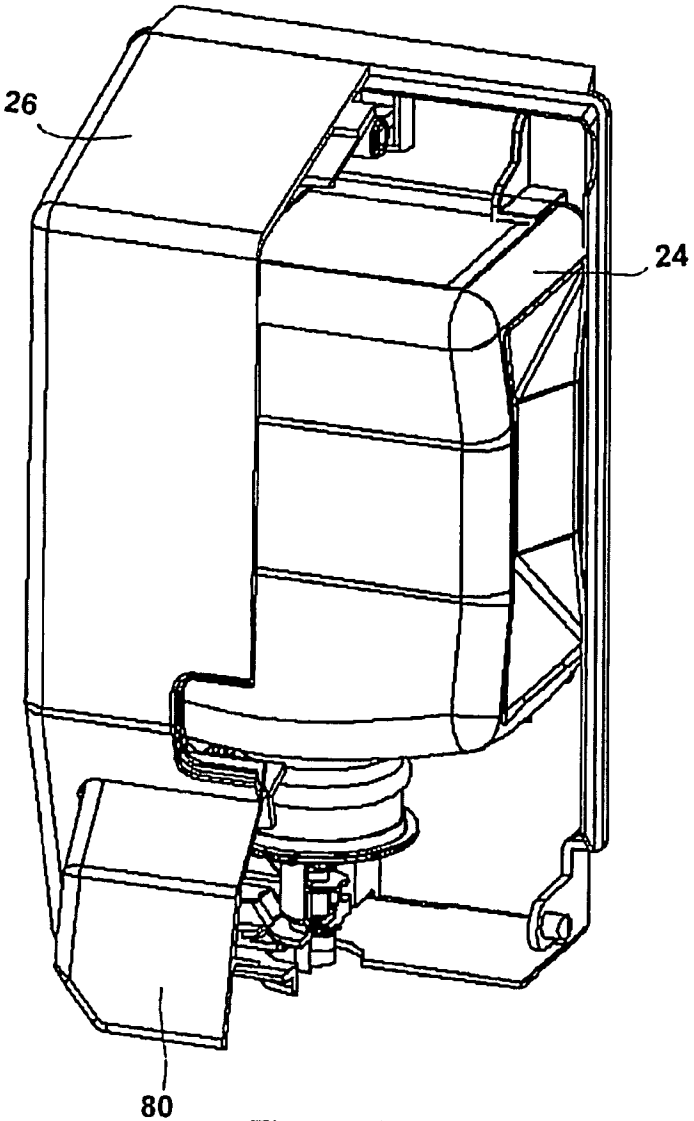
FIG. 15 is a perspective view of a soap dispenser including a nozzle and having a portion of the outer shell broken away.
Figure 17:
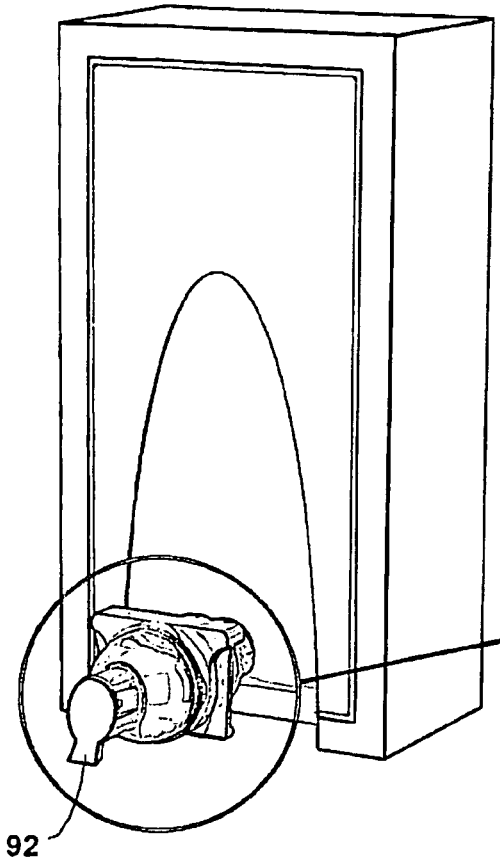
FIG. 17 is a perspective view of an alternate soap dispenser.
Figure 18:
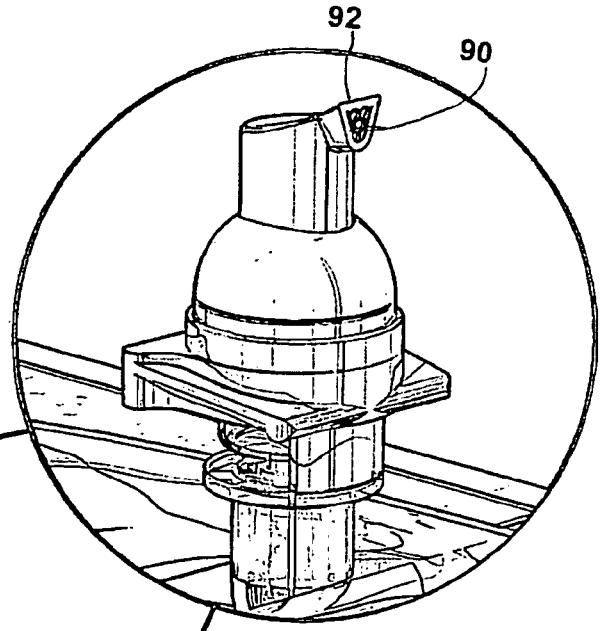
FIG. 18 is a perspective view of the nozzle portion of the dispenser of FIG. 17.
Figure 19:
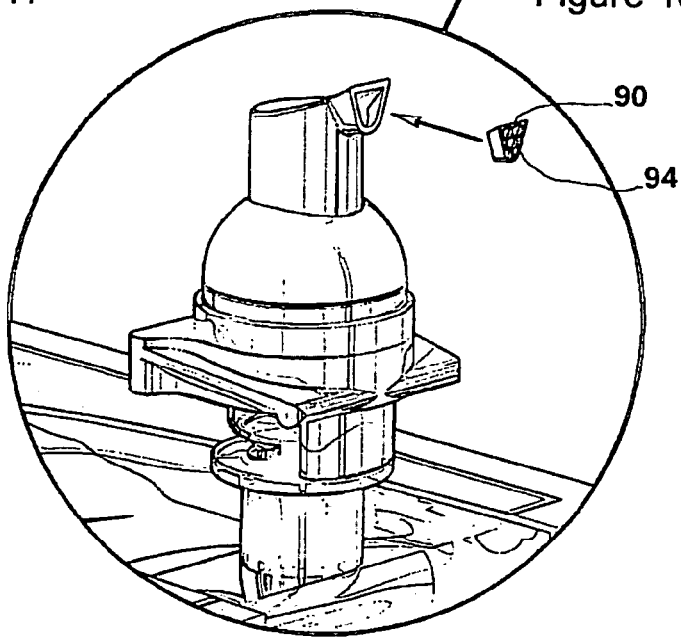
FIG. 19 is a perspective view of the nozzle portion of the dispenser of FIGS. 17 and 18 but showing the anti-drip device separated therefrom.

Nozzle 10 described above is particularly of use with foam dispenser 26 shown in FIGS. 15 and 16. Nozzle 10 is attached to collapsible bottle 24 housed in foam dispenser 26. It will be appreciated that this dispenser is included by way of example only and that the anti-drip device of the present invention could be used with a wide variety of liquid and foam dispensers. This dispenser has a self cleaning aspect that when the actuator 80 is released air is sucked back up through the nozzle. Another example of a foam dispenser that the anti-drip device of the present may be use with is shown in FIGS. 17 to 19. As shown herein the anti-drip device 90 is press fit into the nozzle 92. Anti-drip device 90 has a honeycomb pattern 94 formed on the inside thereof to increase the surface area at the exit of the nozzle 92.

It will be appreciated by those skilled in the art that the particular configuration of the anti-drip device or anti-drip devices and the position of the gauze will depend on the dispenser being used and the viscosity and other properties of the soap being dispensed. As well, the particular configuration chosen may depend on the method of manufacture that is chosen.

Generally speaking, the systems described herein are directed to anti-drip devices for use with liquid soap dispensers and in particular with foam dispensers. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to anti-drip devices.

As used herein, the terms "comprises" and "comprising" are to be construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A liquid soap dispenser for dispensing foam, the dispenser having an anti-drip device, a plain insert, a nozzle and being connected to a bottle, wherein the dispenser is for use with low viscosity soap, the anti-drip device having an outer cross sectional dimension, an inner cross sectional dimension and an inner surface, the anti-drip device being adapted to be positioned in the nozzle, the outer cross sectional dimension defines a length and the inner surface defines a plurality of lengths and the inner cross sectional dimension being the sum of the plurality of lengths of the inner surface and wherein the inner surface is shaped so as to increase the surface area and such that the inner cross sectional dimension is larger than a length of the outer cross sectional dimension, and the plain insert having an outer cross section and an inner cross section and wherein the outer cross section has generally the same shape as the inner cross section and the plain insert has a porous member attached to one side thereof, and the plain insert is one of upstream and downstream of the anti-drip device.

2. The liquid soap dispenser as claimed in claim 1 wherein the inner surface has a honeycomb configuration.

3. The liquid soap dispenser as claimed in claim 1 wherein the inner surface has a plurality of arms extending inwardly.

4. The liquid soap dispenser as claimed in claim 3 wherein the inner surface further includes an inner portion that connects the plurality of arms.

5. The liquid soap dispenser as claimed in claim 1 further includes a porous member attached to the anti-drip device.

6. The liquid soap dispenser as claimed in claim 1 wherein the porous member is attached to an upstream side of the plain insert and the plain insert is upstream of the anti-drip device.

7. The liquid soap dispenser as claimed in claim 1 wherein the porous member is attached to an downstream side of the plain insert and the plain insert is downstream of the anti-drip device.

8. The liquid soap dispenser as claimed in claim 6 further including a porous member attached to the anti-drip device.

9. The liquid soap dispenser as claimed in claim 7 further including a porous member attached to the anti-drip device.

10. The liquid soap dispenser as claimed in claim 8 wherein each porous member is gauze and the gauze attached to the anti-drip device is of a finer mesh than the gauze attached to the plain insert.

11. The liquid soap dispenser as claimed in claim 9 wherein each porous member is gauze and the gauze attached to the plain insert is of a finer mesh than the gauze attached to the anti-drip device.

12. The liquid soap dispenser as claimed in claim 1 wherein the anti-drip device is integrally formed in the nozzle.

13. The liquid soap dispenser as claimed in claim 1 wherein the anti-drip device is adapted to be press fit into the nozzle.

14. The liquid soap dispenser as claimed in claim 13 wherein the nozzle has at least one detent extending inwardly to hold the insert in position in the nozzle.

15. The liquid soap dispenser as claimed in claim 1 further including a plurality of anti-drip devices.

16. The liquid soap dispenser as claimed in claim 15 wherein at least one of the plurality of anti-drip devices has a porous member attached thereto.

17. The liquid soap dispenser as claimed in claim 15 wherein each anti-drip device has a porous member attached thereto.

* * * * *